US010727013B2

(12) United States Patent
Jonsson

(10) Patent No.: US 10,727,013 B2
(45) Date of Patent: Jul. 28, 2020

(54) GAS-INSULATED LOW- OR MEDIUM-VOLTAGE SWITCH WITH SWIRLING DEVICE

(71) Applicant: ABB Schweiz AG, Baden (CH)

(72) Inventor: Erik Jonsson, Ranheim (NO)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/311,890

(22) PCT Filed: Jun. 19, 2017

(86) PCT No.: PCT/EP2017/064957
§ 371 (c)(1),
(2) Date: Dec. 20, 2018

(87) PCT Pub. No.: WO2017/220501
PCT Pub. Date: Dec. 28, 2017

(65) Prior Publication Data

US 2019/0206644 A1 Jul. 4, 2019

(30) Foreign Application Priority Data

Jun. 20, 2016 (EP) ..... 16175162

(51) Int. Cl.
*H01H 1/38* (2006.01)
*H01H 33/12* (2006.01)
(Continued)

(52) U.S. Cl.
CPC ..... *H01H 33/7038* (2013.01); *H01H 33/56* (2013.01); *H01H 33/7046* (2013.01);
(Continued)

(58) Field of Classification Search
CPC ..... H01H 33/56; H01H 33/565; H01H 33/64; H01H 33/7023; H01H 33/703;
(Continued)

(56) References Cited

U.S. PATENT DOCUMENTS 2,943,173 A * 6/1960 Level ..... H01H 3/30 218/116
3,708,639 A * 1/1973 Vigreux ..... H01H 33/703 218/53
(Continued)

FOREIGN PATENT DOCUMENTS

CN 101162663 A 4/2008
CN 102364656 A 2/2012
(Continued)

OTHER PUBLICATIONS

Translation of CN101162663 (Original published Nov. 27, 2013) (Year: 2013).*
(Continued)

*Primary Examiner* — William A Bolton
(74) *Attorney, Agent, or Firm* — Whitmyer IP Group LLC

(57) ABSTRACT

A gas-insulated low- or medium-voltage switch for system voltages within 1 to 52 kV and for up to 2000 A rated current includes first and second contacts being movable in relation to each other along an axis of the switch and defining a quenching region in which an arc is formed during a current breaking operation; and an arc-extinguishing system for extinguishing the arc during the current breaking operation. The arc-extinguishing system may include a pressurization system with a puffer chamber, and a nozzle system connecting the pressurization system with the quenching region, the nozzle system having a nozzle at its outlet for blowing the pressurized quenching gas onto the arc formed in the quenching region during the current breaking operation; and a swirling device configured for generating a subsonic swirl flow of a quenching gas onto the quenching region during the current breaking operation, wherein the swirling device is arranged at an entrance of the nozzle system. The arc-extinguishing system further includes a swirling device configured for generating a subsonic swirl flow of a quench-
(Continued)

ing gas onto the quenching region during the current breaking operation, wherein the swirling device is arranged at an entrance of the nozzle system.

19 Claims, 2 Drawing Sheets

(51) Int. Cl.
*H01H 33/56* (2006.01)
*H01H 33/70* (2006.01)
*H01H 33/90* (2006.01)

(52) U.S. Cl.
CPC ..... *H01H 1/385* (2013.01); *H01H 33/121* (2013.01); *H01H 33/90* (2013.01); *H01H 2033/566* (2013.01)

(58) Field of Classification Search
CPC ..... H01H 33/7038; H01H 33/7046; H01H 33/90; H01H 33/88; H01H 1/385; H01H 33/121; H01H 2033/566
USPC ..... 218/51, 53, 57, 59, 60, 63, 62
See application file for complete search history.

(56) References Cited

U.S. PATENT DOCUMENTS

| | | | | |
|---|---|---|---|---|
| 3,909,572 | A | 9/1975 | Tsubaki et al. | |
| 3,946,183 | A * | 3/1976 | Milianowicz | H01H 33/703 218/66 |
| 4,663,504 | A * | 5/1987 | Barkan | H01H 33/02 200/302.3 |
| 7,078,643 | B2 * | 7/2006 | Rostron | H01H 33/166 218/144 |
| 8,389,886 | B2 * | 3/2013 | Dahlquist | H01H 33/74 218/45 |
| 2013/0265693 | A1 * | 10/2013 | Panousis | H01H 33/08 361/634 |

FOREIGN PATENT DOCUMENTS

| | | | | |
|---|---|---|---|---|
| CN | 102938349 | A | 2/2013 | |
| CN | 203013625 | U | 6/2013 | |
| CN | 103367027 | A | 10/2013 | |
| CN | 101162663 | B | 11/2013 | |
| CN | 1011162663 | * | 11/2013 | H01H 33/88 |
| DE | 1195392 | B | 6/1965 | |
| FR | 2377695 | A1 | 8/1978 | |
| JP | H07176245 | A | 7/1995 | |
| JP | H10312730 | A | 11/1998 | |
| JP | 2010244742 | A | 10/2010 | |
| JP | 2014229363 | A | 12/2014 | |
| WO | 2009140999 | A1 | 11/2009 | |
| WO | 2014154292 | A1 | 10/2014 | |

OTHER PUBLICATIONS

European Search Report Application No. EP 16 17 5162 Completed: Nov. 16, 2016; dated Nov. 30, 2016 7 pages.
International Preliminary Report on Patentability Application No. PCT/EP2017/064957 Completed: Sep. 19, 2018; dated Sep. 19, 2018 15 pages.
International Search Report and Written Opinion of the International Searching Authority Application No. PCT/EP2017/064957 Completed: Aug. 8, 2017; dated Aug. 23, 2017 13 pages.
Written Opinion of the International Searching Authority Application No. PCT/EP2017/064957 dated May 23, 2018 8 pages.
Chinese Office Action, Search Report and Translation Application No. 2017800381236 dated May 31, 2019 9 Pages.
Chinese Office Action and Translation Application No. 2017800381236 dated Sep. 27, 2019 7 Pages.
Chinese Office Action and Translation, Application No. 2017800381236, dated Mar. 5, 2020, 10 pages.
J.C. Henry; et al "Papers from International Council on Large Electric Systems" 1972; Accessed on May 13, 2020 http://www.yishuleia.cn/, 7 pages with translated abstract.

* cited by examiner

GAS-INSULATED LOW- OR MEDIUM-VOLTAGE SWITCH WITH SWIRLING DEVICE

TECHNICAL FIELD

Aspects of the present invention generally relate to a gas-insulated low- or medium-voltage switch with arc-extinguishing capability, to a distribution network, Ring Main Unit, or secondary distribution gas-insulated switchgear having such a load break switch, and to a method of breaking a current using the load break switch.

BACKGROUND

Gas-insulated low- or medium-voltage switches are used in a variety of settings such as in a distribution networks, Ring Main Units, or secondary distribution gas-insulated switchgear. When switching a current, the switch is opened by relative movement of the contacts (plug and pipe) away from each other, whereby an arc can form between the separating contacts. In order to extinguish such an arc, some types of switches are equipped with an arc-extinguishing system. In one type of switch, an arc-extinguishing system operates by releasing a quenching gas towards the arc for cooling down and finally extinguishing the arc.

Typically, low cost and reliability of operation are two main factors for low- or medium-voltage switches. Therefore, it is generally desired to use simple and cost-efficient components for each part of the switch. In particular, a design enabling a low-cost drive of the switch is generally favoured.

SUMMARY

An object of the invention is to provide an improved gas-insulated low- or medium-voltage switch, which allows for reliable arc extinction while still maintaining at least to some extent a relatively a low-cost and compact design.

According to a first aspect of the invention, a gas-insulated low- or medium-voltage switch for system voltages within 1 to 52 kV and for up to 2000 A rated current is provided. The switch comprises first and second contacts being movable in relation to each other along an axis of the switch and defining a quenching region in which an arc is formed during a current breaking operation; and an arc-extinguishing system for extinguishing the arc during the current breaking operation. The arc-extinguishing system comprises a swirling device configured for generating a subsonic swirl flow of a quenching gas onto the quenching region during the current breaking operation.

Next we describe some further preferred (i.e., optional) aspects of the switch. According to an aspect, the arc-extinguishing system comprises a pressurization system having a pressurizing chamber for pressurizing the quenching gas during the current breaking operation, wherein the pressurizing chamber is a puffer chamber with a piston arranged for compressing the quenching gas within the puffer chamber during the current breaking operation, and one of the piston and a remaining portion of the puffer chamber is movable together with the first or second arcing contact portion; and a nozzle system connecting the pressurization system with the quenching region, the nozzle system having a nozzle at its outlet for blowing the pressurized quenching gas onto the arc formed in the quenching region during the current breaking operation. According to a further aspect, the swirling device is arranged at an entrance of the nozzle system.

According to an aspect, the arc-extinguishing system is a pressurizing system (e.g. puffer system) having a pressurizing chamber for pressurizing the quenching gas (which may be just pressurized insulation gas) to a quenching pressure $p_{quench}$ during the current breaking operation, and a nozzle system for directing the pressurized quenching gas towards the quenching region. The quenching pressure $p_{quench}$ is defined as the maximum (uniform) pressure within the pressurizing chamber during a current breaking operation, and preferably satisfies $p_0<p_{quench}<1.8*p_0$. Herein, $p_0$ is the ambient pressure (background pressure within the bulk volume 6).

Whether the flow pattern is supersonic or not depends in this type of switch on the pressure difference between the quenching pressure $p_{quench}$ and the ambient pressure $p_0$. As defined herein, a subsonic flow pattern is present under the condition that $p_{quench}<1.8*p_0$.

According to an aspect, the switch is a load break switch. As defined herein, a load break switch has a capability to switch load currents, but does not have short-circuit switching capability. The load current is also referred to as the rated current or nominal current of the switch, and is up to 2000 A, preferably up to 1250 A, more preferably up to 1000 A. Currents in this range are typical rated currents used in distribution networks, ring main units, and secondary distribution GIS (gas insulated switchgear). The rated currents may on the other hand be more than 1 A, more preferably more than 100 A, more preferably more than 400 A. In case of an AC load breaker, the rated current is herein indicated in terms of the rms current.

Herein, a low or medium voltage is defined as a voltage of up to at most 52 kV. The low- or medium-voltage load break switch therefore has a rated voltage of at most 52 kV. The rated voltage may, in particular, be at most 52 kV, or preferred at most 36 kV, or more preferred at most 24 kV, or most preferred at most 12 kV. The voltage rating may be at least 1 kV.

Thus, embodiments of the invention enable a more efficient arc cooling/quenching efficiency compared with the conventional design, and thus enable to thermally interrupt the load currents for a wide range of possible ratings of load break switches and/or by an alternative quenching gas as mentioned herein.

Further advantages, features, aspects and details that can be combined with embodiments described herein are evident from the dependent claims, the description and the drawings.

BRIEF DESCRIPTION OF THE DRAWINGS

The invention will be explained in greater detail with reference to the accompanying drawings, wherein.

DETAILED DESCRIPTION

Figure 1A:
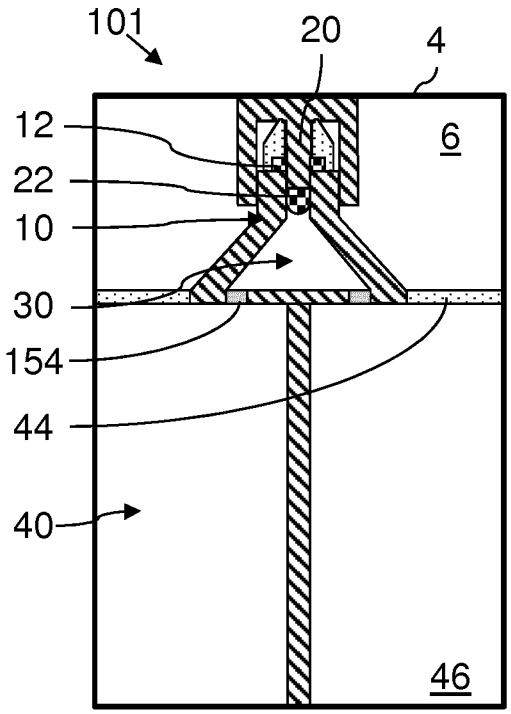
FIGS. 1*a*-1*b* show a cross-sectional view of a load break switch according to a comparative example, in a closed state (FIG. 1*a*) and during a current breaking operation (FIG. 1*b*)

Within the following description of embodiments shown in the drawings, the same reference numbers refer to the same or to similar components. Generally, only the differences with respect to the individual embodiments are described. Unless specified otherwise, the description of a part or aspect in one embodiment applies to a corresponding part or aspect in another embodiment as well.

Figure 2A:
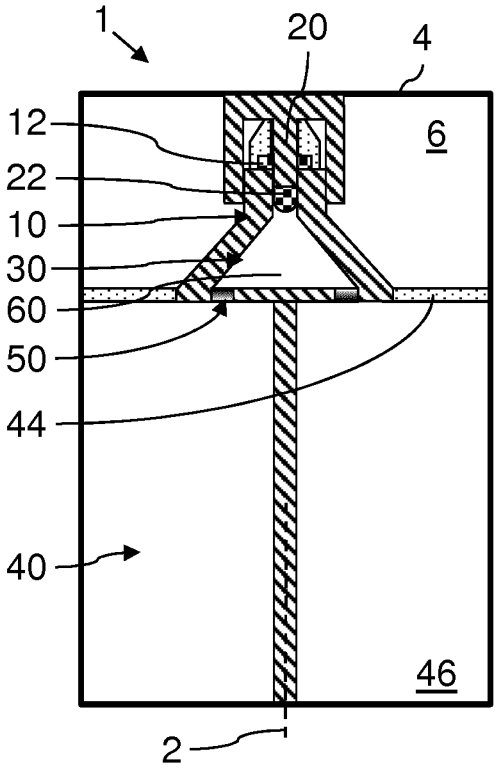
FIGS. 2*a*-2*b* show a cross-sectional view of a load break switch according to an embodiment of the invention, in a closed state (FIG. 2*a*) and during a current breaking operation (FIG. 2*b*)
Figure 2B:
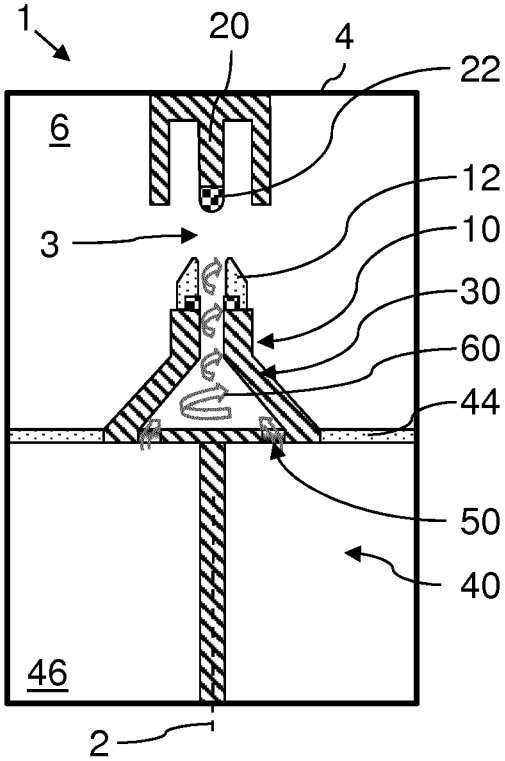

FIGS. 2*a* and 2*b* show a cross-sectional view of a load break switch 1 according to an embodiment of the invention. In FIG. 2*a*, the switch is shown in a closed state, and in FIG. 2*b* the switch is shown during a current breaking operation.

The switch 1 has a gas-tight housing 4 whose inner volume 6 is filled with an electrically insulating gas at an ambient pressure $p_0$.

Within the volume 6 is a first contact 10 and a second contact 20. The first contact 10 is a movable pipe-type contact, and the second contact 20 is a stationary pin-type contact. The first contact 10 is also shown in more detail in FIG. 3. The first contact 10 has a first arcing contact portion 12, and the second contact 20 has a second arcing contact portion 22.

In the closed state of FIG. 2*a*, the second contact 20 is inserted into the first contact 10. During the current breaking operation, as shown in FIG. 2*b*, the first contact 10 moves away from the second contact 20 so that both contacts separate from one another. Thereby, an arc (not shown in FIG. 2*b*) develops in the arcing region 3 between the first and second arcing contact portions 12, 22.

Integrated in the first contact 10 is an arc-extinguishing system 30 for extinguishing the arc. The arc-extinguishing system 30 has a pressurizing system (puffer system) 40 and a nozzle system 60. The pressurizing system 40 includes a pressurizing chamber (puffer chamber) 46 having a quenching gas contained therein. The quenching gas is a portion of the insulation gas contained in the housing volume 6 of the switch. The pressurizing chamber 46 is delimited by a chamber wall and a piston 44 for compressing the quenching gas within the pressurizing chamber 46 during the current breaking operation. To this purpose, the piston 44 moves jointly with the first contact 10 so that the piston 44 pressurizes the quenching gas within the pressurizing chamber 46 when the first contact 10 is moved away from the second contact 20 for opening the switch, as shown in FIG. 2*b*. Thereby, the energy for pressurizing the quenching gas is ultimately provided by the drive driving the first contact 10.

The nozzle system 60 is adapted for blowing the pressurized quenching gas from the pressurization system 40 onto the arc formed during the current breaking operation. The nozzle system 60 has an inlet connected to the pressurizing chamber 46 for receiving the pressurized quenching gas from the pressurizing chamber 46, and a nozzle outlet to the quenching region 3.

During a switching operation, as shown in FIG. 2*b*, the first (movable) contact 10 is moved by a drive (not shown) along the axis 2 away from the second (stationary) contact 20 (downwards in FIG. 2*b*). Thereby, the arcing contact portions 12 and 22 are separated from one another, and an arc (not shown) forms in the quenching region 3 between both contacts 10 and 20. Further, as described above the piston 44 is also moved thereby compressing the pressurizing volume 46, so that the quenching gas contained therein is brought to a quenching pressure $p_{quench}$. The quenching pressure $p_{quench}$ is defined as the maximum overall pressure within the pressurizing chamber 46 during a current breaking operation.

The pressurized quenching gas flows from the pressurizing chamber 46 to the nozzle system 60 and is then blown onto the arc formed in the quenching region 3, thereby extinguishing the arc.

The pressurizing system 40 and the nozzle system 60 are dimensioned such that the flow of the quenching gas is subsonic. This subsonic flow amounts to a relatively low quenching pressure $p_{quench}$ in the pressurizing chamber ($p_{quench}<1.8*p_0$, as defined herein), and therefore imposes only modest requirements on the drive of the switch.

At the inlet of the nozzle system 60 (from the pressurizing chamber 46), a swirling device 50 is provided. During the current breaking operation shown in FIG. 2*b*, the swirling device 50 exerts a swirling torque on the quenching gas flowing from the pressurizing chamber 46 to the nozzle system 60 such as to generate a swirl flow of the quenching gas. The swirl flow is defined as a rotational flow around the switch axis superimposed on the axial flow of the quenching gas. Thus, the quenching gas has a rotational flow component about the axis 2 as indicated by the arrows in FIG. 2*b*. This swirl flow of quenching gas is then released, by the nozzle system 60, onto the quenching region 3.

Figure 4:
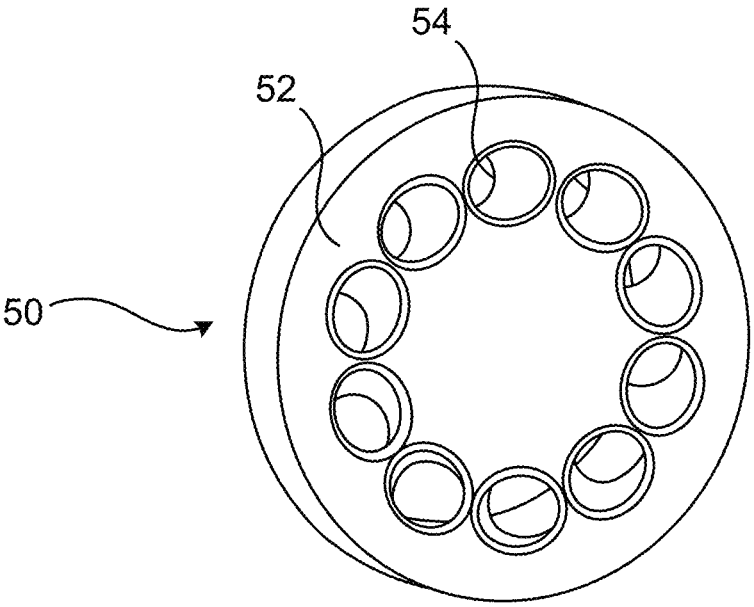
FIG. 4 shows a perspective view of a swirling device of the switch of FIGS. 2*a* and 2*b*.

The swirling device 50 can, for example, be provided by a swirl plate 52 as shown in FIG. 4, having openings 54. The openings 54 connect the pressurizing system (chamber 46) with the nozzle system 60. The openings 54 extend predominantly axially, so that the quenching gas flowing through the openings 54 has an axial flow component.

Each of the openings 54 is inclined, with respect to the axis 2, by a predetermined angle in a (predominantly) circumferential direction (the predetermined angle being more than 0° but less than 90°). The quenching gas flowing through the openings 54 is directed along the inclination angle of the openings 54, and is thereby imparted the swirling torque.

Figure 3:
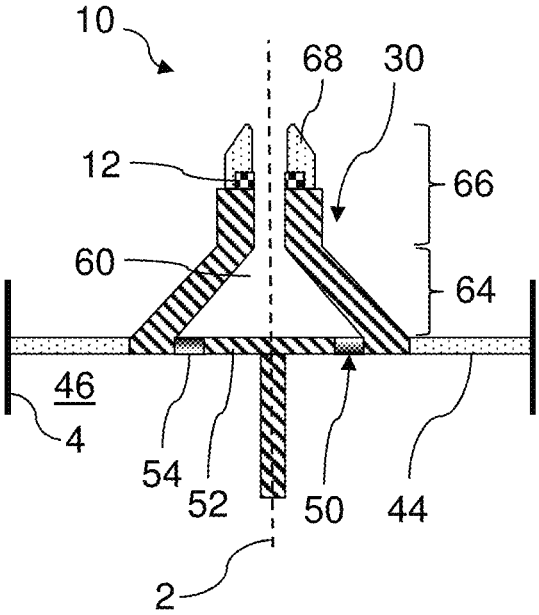
FIG. 3 shows in more detail the first contact of the switch of FIGS. 2*a* and 2*b;*
Figure 5:
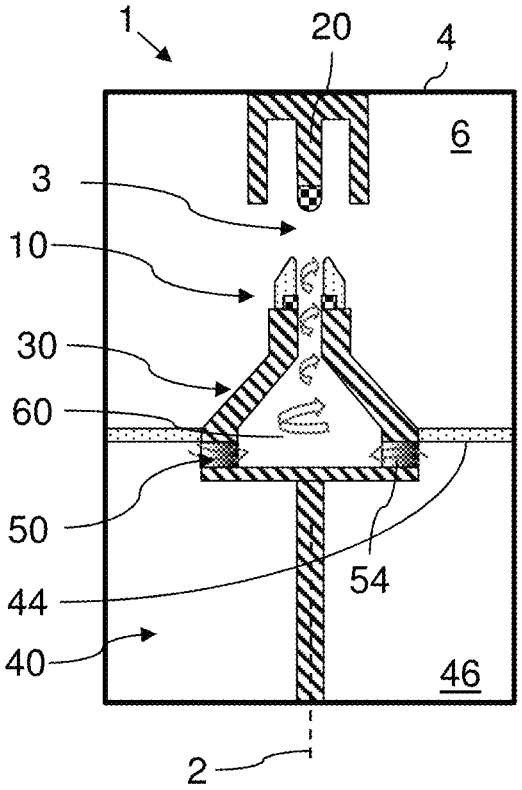
FIG. 5 shows a cross-sectional view of a switch according to a further embodiment of the invention.

The swirling device 50 is not limited to the swirling plate 52 shown in FIGS. 3 and 4, but may be provided in a number of alternative ways. One example is shown in FIG. 5. Except where described below, the first contact 10 shown in FIG. 5 corresponds to that of FIG. 3, with the same reference signs indicating analogous parts, and the above description also applies to FIG. 5 unless indicated otherwise and/or incompatible with FIG. 5.

Differently from FIG. 3, the swirling device 50 of FIG. 5 has predominantly radial openings through which the quenching gas flows with a radial component. Again, the openings are inclined by a predetermined angle in a (predominantly) circumferential direction (the predetermined angle being more than 0° but less than 90°), so that the quenching gas flowing through the openings is imparted the swirling torque.

Also, combinations of the openings with both radial and axial flow component—and of course an inclination in circumferential direction for imparting the torque—are possible.

Further alternative swirling devices are possible. For example, the swirling device may comprise guiding plates or guiding channels, e.g. provided in an entrance portion of the nozzle system 60, and being formed for imparting a swirling torque on the quenching gas. As a further alternative, the swirling device may comprise a rotor which is rotatable about the switch axis 2 for imparting a torque on the quenching gas. The rotor may be provided in an entrance portion of the nozzle system 60 and be driven by the drive of the switch 1.

The inventors observed that this swirl flow allows a more efficient extinguishing of the arc at a given quenching pressure. The effect of the swirl flow can be appreciated by comparison with the switch 101 of FIGS. 1*a* and 1*b* as a comparative example. The comparative switch 101 corresponds to the switch 1 of FIGS. 2*a* and 2*b*, except that the comparative switch 101 does not include a swirling device 50. Hence, in FIGS. 1*a* and 1*b* the same reference signs are used as in FIGS. 2*a*-3, and the above description of FIGS. 2*a* to 3 also applies—except the description of the swirling device 50—to the comparative switch 101 of FIGS. 1*a* and 1*b*. In FIG. 1*a*, the comparative switch is shown in a closed state, and in FIG. 2*b* during a current breaking operation.

Figure 1B:
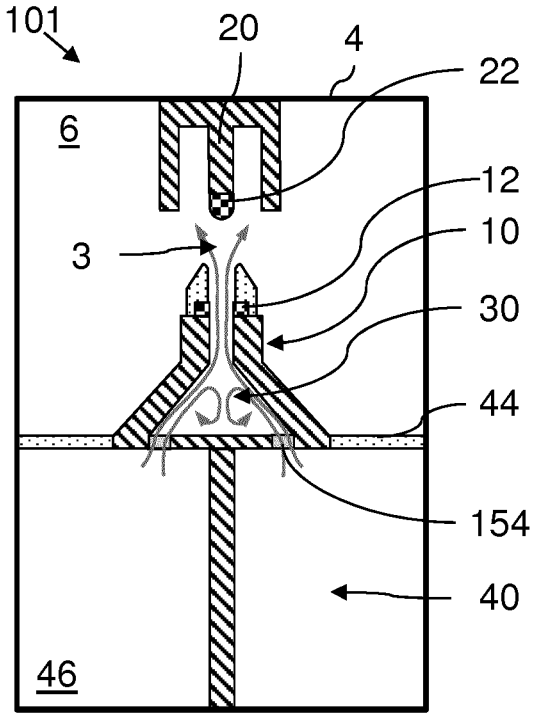

Instead of a swirling device 50, the comparative switch of FIGS. 1*a* and 1*b* merely has non-inclined holes 154 at the inlet of the nozzle system 60. These non-inclined holes 154 extend in the axial direction of the switch, and therefore do not impart any torque or swirling on the quenching gas. The inventors observed that that compared to the comparative switch without swirling device 50 as in FIGS. 1*a* and 1 *b*, the switch according to the invention (FIGS. 2*a* to 3) has a superior arc extinguishing capability when driven by the same drive force, or allows for lower drive power (less over pressure in the pressurizing volume 46) while still generating an air flow which ensures reliably extinguishing the arc.

Although the invention is not bound by this theory, it is believed that in the nozzle system 60 of the conventional switch, vortices are created upon a current breaking operation, as indicated schematically by arrows in FIG. 1*b* indicating the flow of quenching gas through the nozzle system 60. These vortices are effectively suppressed or reduced by the swirl flow, as indicated in FIG. 2*b*. Thereby the flow of quenching gas through the nozzle system 60 is facilitated, and/or the overpressure in the pressurizing volume 46, against which the drive has to provide work, is reduced.

These advantages are not limited to the embodiments shown in FIGS. 2*a* to 5, but the switch may be modified in a plurality of ways. In the following, some general preferred aspects of the invention are described. These aspects allow for a particularly beneficial arc extinction due to a synergy with the presence of the swirling device 50. The description uses the reference signs of FIGS. 2*a* to 4 for illustration, but the aspects are not limited to this embodiment. Each of these aspects can be used only by itself or combined with any other aspect(s) described herein.

First, aspects regarding the contacts 10 and 20 are described.

According to an aspect, the first contact 10 has a tube-like geometry. The second contact 20 has a pin-like geometry and is, in the closed configuration, inserted in the first contact 10.

According to a further aspect of the invention, the load break switch is of single-motion type. According to an aspect, the first contact 10 is a movable contact and can be moved along the axis 2 away from the second (stationary) contact 20 for opening the switch. The first contact is driven by a drive.

According to a further aspect, the first and second contacts 10, 20 have arcing portions 12, 22 for carrying an arc during a current breaking operation. The arcing portions 12, 22 define a quenching region 3 in which the arc develops. According to an aspect, the first contact 10 has an insulating nozzle tip on a distal side of its arcing portion 12. On the other hand, the arcing portion 22 may be arranged at a distal tip portion of the second contact 20.

According to a further aspect, the first and second arcing contact portions have a maximum contact separation of up to 150 mm, preferably up to 110 mm, and/or of at least 10 mm, and preferably of 25 to 75 mm.

Next, aspects regarding the pressurizing system 40 are described.

In an aspect of the invention, the pressurizing system is a puffer system. Therein, the pressurizing chamber is a puffer chamber with, e.g., a piston arranged for compressing the quenching gas within the puffer chamber during the current breaking operation. Thus, according to a related aspect of the invention, the nozzle system is a puffer-type nozzle system without self-blast effect. Optionally, the puffer chamber is pressurized by movement of the first or second arcing contact portion. Optionally, the first or second arcing contact portion is movable, and one of the piston and a remaining portion of the puffer chamber is movable together with the first or second arcing contact portion, whereas the other one of the piston and the remaining portion of the puffer chamber is stationary.

In a further aspect, the arc-extinguishing system 30 may comprise a pressurization system 40 with a puffer chamber, and a nozzle system 60 connecting the pressurization system 40 with the quenching region 3, the nozzle system 60 having a nozzle 68 at its outlet for blowing the pressurized quenching gas onto the arc formed in the quenching region 3 during the current breaking operation; and a swirling device 50 configured for generating a subsonic swirl flow of a quenching gas onto the quenching region 3 during the current breaking operation, wherein the swirling device 50 is arranged at an entrance of the nozzle system 60.

In a further aspect, the pressurizing system 40 may be configured for pressurizing the quenching gas during the current breaking operation to a quenching pressure $p_{quench}<1.8*p_0$, where $p_0$ is the ambient (equilibrium) pressure of the insulation gas in the bulk volume 6 of the housing, and $p_{quench}$ is the (maximum overall) pressure of the pressurized insulation gas, also referred to as quenching gas, during the current breaking operation in the pressurizing chamber 46. This condition on the quenching pressure ensures that the flow of quenching gas is subsonic, and at the same time limits the requirement of the drive which usually delivers the work of pressurizing the quenching gas.

More preferably the quenching pressure satisfies $p_{quench}<1.5*p_0$ or $p_{quench}<1.3*p_0$ or even $p_{quench}<1.1*p_0$. On the other hand, the quenching pressure preferably satisfies $p_{quench}>1.01*p_0$, so that the pressure build-up is sufficient for extinguishing the arc.

According to a further aspect, the quenching pressure satisfies $p_{quench}<p_0+800$ mbar, preferably $p_{quench}<P_0+500$ mbar, more preferably $p_{quench}<p_0+300$ mbar, and even more preferably $p_{quench}<P_0+100$ mbar. On the other hand, the quenching pressure preferably satisfies $p_{quench}>p_0+10$ mbar.

Typically the ambient pressure of the (bulk) insulation gas in the housing $p_0$ is <=3 bar, more preferably $p_0$<=1.5 bar, and even more preferably $p_0$<=1.3 bar.

A pressure difference meeting at least one of these conditions allows not only for subsonic flow pattern of the quenching gas but also keep the requirements low, and hence also the cost, of the drive of the switch. These limits nevertheless still allow for reasonable arc extinguishing properties within the ratings of a low- or medium load break switch, as long as the swirling device 50 described herein is used. Typically $p_0$<=3 bar, preferably $p_0$<=1.5 bar, more preferably $p_0$<=1.3 bar.

In some embodiments, due to the swirling device 50 that allows the arc to be cooled very effectively, this improvement can be achieved without increasing the pressure build-up of the quenching gas in the nozzle (without increased pressure of the puffer chamber), and thus without increased demand/cost for the drive of the switch. In some embodiments, the pressure build-up may even be reduced.

These pressure conditions are very different from typical flow conditions in high-voltage circuit breakers (rated voltage above 52 kV). In these high-voltage circuit breakers (puffer and self-blast type), the flow conditions are sonic in order to maximize the cooling of the arc. Thereby a much higher pressure built-up, $p_{quench}$ considerably above $1.8*p_0$ (and considerably above $p_0$+800 mbar), is required. This imposes strong requirements on the drive of these high-voltage circuit breakers, which are disadvantageous or even prohibitive, from a cost standpoint, for the low- and medium load breakers considered here. These low- and medium load breakers are a completely different type of switch for completely different applications, design and market than circuit breakers.

According to a further aspect, the pressurizing chamber 46 has a (radial) diameter of 40 to 80 mm, and/or a maximum (axial) length of 40 to 200 mm.

Next, aspects regarding the swirling device 50 are described.

According to an aspect, the swirling device 50 is non-mirror symmetric and has a chirality (left- or right-handedness). The chirality is defined by the handedness of the torque imparted onto the gas flow by the interaction with the swirling device 50.

According to a further aspect, the swirling device 50 has non-symmetric guide elements, in the sense that the guide elements define a preferred rotational orientation (left- or right-handed), and thus the swirl flow, of the quenching gas passing along the guide elements. According to an aspect, the guide elements are inclined by a predetermined angle in a (predominantly) circumferential direction (the predetermined angle being more than 0° but less than 90°), so that the quenching gas flowing along the guide elements is imparted the swirling torque. The circumferential inclination direction, and preferably the circumferential inclination angle, of each of the guide elements is preferably the same.

The guide elements are preferably openings 54. Thus, the quenching gas flowing through the openings 54 is guided along the inclination angle of the openings 54, and is thereby imparted the torque.

According to a further aspect, the openings 54 are partially axially extending, so that the quenching gas flows though the openings with an axial component. Alternatively or in addition, the openings may be partially radially extending, so that the quenching gas flows though the openings with a radial component.

According to a further aspect, the swirling device 50 is arranged at a (pressurization-system side) entrance of the nozzle system 60 or directly upstream of the nozzle system 60.

According to a further aspect, the swirling device 50 is concentrically arranged with a center axis 2 of the switch. According to a further aspect, the openings are arranged at an off-axis position with respect to a central axis 2 of the switch.

According to a further aspect, the swirling device 50 is fixed to the first contact 10 (with no movable components with respect to the first contact 10).

According to a further aspect, the swirling device is arranged at an entrance of the nozzle system. The entrance can be a pressurization-system side entrance, i.e. an entrance from the pressurization system. The entrance connects the pressurization-system to the nozzle system. This connection may be axially and/or radially oriented, and the orientation may also have a circumferential component for imparting the swirl. The swirling device may partially extend from the entrance into the nozzle system and/or into the pressurization system.

According to a further aspect, the swirling device comprises a plurality of circumferentially inclined channel portions connecting the pressurization system to the nozzle system. The channel portions may be arranged at intervals along a circle, the circle being concentrical to the axis. The channel portions may have an axial and/or a radial component. The channel portions may be provided through a wall surface of the nozzle system, e.g., a bottom wall surface orthogonal to the axis or a circumferential wall surface parallel to the axis.

Next, aspects regarding the nozzle system 60 are described, which allow for a particularly beneficial arc extinction in synergy with the swirling device 50.

According to an aspect, the nozzle system 60 is fixedly joined to the first (movable) contact 10 and/or co-moveable with the first contact 10 and/or driven by the drive unit which drives the first contact 10.

According to a further aspect, the nozzle system 60 is tapered (at least in a section 64 thereof) such that a final diameter at the exit (section 66) of the nozzle system is smaller than a diameter at an upstream portion (e.g., entrance portion) of the nozzle system 60. According to a further aspect, the nozzle system 60 has a first channel section 64 of larger diameter and a second channel section 66 of smaller diameter downstream of the first channel section 64. Thereby an accelerated flow of quenching gas at the exit of the nozzle system is generated. Herein, the diameter is defined as the (largest) inner diameter of the respective section, and "upstream", "downstream" always refers to the flow direction of the quenching gas during a current breaking operation.

According to a further aspect, the diameter of the nozzle system 60 is continuously (i.e., in a non-stepwise manner) reduced from the first channel section 64 to the second channel section 66. The first channel section 64 and the second channel section 66 are preferably adjacent to each other. The first channel section 64 is preferably located at an entrance of the nozzle system 60, and the second channel section 66 is preferably located at an outlet of the nozzle system 60.

According to a further aspect, the second channel section 66 extends in the direction of the switch axis 2. According to a further aspect, the second channel section 66 has a substantially constant diameter over an axial length, the axial length being at least 10 mm, preferably at least 20 mm. According to a further aspect, the second channel section 66 has a diameter of at least 5 mm and/or at most 15 mm.

According to a further aspect, the nozzle system 60 extends parallel to a center axis 2 of the switch and preferably extends along (overlapping) the center axis 2 and/or concentrically with the center axis 2. According to a further aspect, the nozzle system 60 extends axially through the first contact 10, and the nozzle outlet is formed by a hollow tip section of the first contact 10.

According to a further aspect, the swirling device 50 is located within the nozzle system 60 (at its entrance portion) or directly upstream of the nozzle system 60, and in particular within the first channel section 64 or directly upstream of the first channel section 64.

According to a further aspect, the nozzle system has a tapered section in which the cross-sectional area is gradually reduced in flow direction (e.g., leading to a constricted nozzle). The swirling device may be arranged upstream of the tapered section. With this arrangement, the swirl allows an efficient flow through the tapered section. In addition, the swirl is amplified in the tapered section, so that a given final swirl can be achieved even with a weak swirling device 50 with small resistance to the flow of the quenching gas.

According to a further aspect, the nozzle (68) at the outlet of the nozzle system 60 is formed to extend axially through the (hollow) tip section of the first contact 10, e.g., formed as an axially extending tube portion at the tip section of the first contact 10. The nozzle 68 may be positioned to extend concentrically with the center axis of the switch and/or for receiving the second contact 20 (the second contact 20 being, e.g., a pin contact).

According to a further aspect, the nozzle 68 at the outlet of the nozzle system 60 is arranged for blowing onto the quenching region from a substantially axial direction (which does not exclude a circumferential flow component due to the swirl but which excludes a radial angle of more than 10° of the flow at the nozzle outlet).

According to a further aspect, the nozzle 68 is positioned at the center axis of the switch, e.g., extending along the center axis of the switch (without radial distance from the axis). The inlet of the nozzle system 60 may be positioned at a radial distance from the axis.

According to a further aspect, first contact 10 is movable, and the nozzle system 60 is movable together with the first contact.

Next, aspects regarding the insulation gas are described.

By applying the swirl flow described herein to a Low- or Medium-Voltage load break switch, its thermal interruption performance can be significantly improved. This permits, for example, the use with an insulation gas being different from SF6. SF6 has excellent dielectric and arc quenching properties, and has therefore been conventionally used in gas-insulated switchgear. However, due to its high global warming potential, there have been large efforts to reduce the emission and eventually stop the usage of such greenhouse gases, and thus to find alternative gases by which SF6 may be replaced.

Such alternative gases have already been proposed for other types of switches. For example, WO2014154292 A1 discloses an SF6 free switch with an alternative insulation gas. Replacing SF6 by such alternative gases is technologically challenging, as SF6 has extremely good switching and insulation properties, due to its intrinsic capability to cool the arc.

According to an aspect, the present configuration allows the use of an alternative gas (e.g., as described in WO2014154292 A1) having a global warming potential lower than the one of SF6 in a load break switch, even if the alternative gas does not fully match the interruption performance of SF6.

The insulation gas preferably has a global warming potential lower than the one of SF6 over an interval of 100 years. The insulation gas may for example comprise at least one background gas component selected from the group consisting of $CO_2$, $O_2$, $N_2$, $H_2$, air, $N_2O$, in a mixture with a hydrocarbon or an organofluorine compound. For example, the dielectric insulating medium may comprise dry air or technical air. The dielectric insulating medium may in particular comprise an organofluorine compound selected from the group consisting of: a fluoroether, an oxirane, a fluoramine, a fluoroketone, a fluoroolefin, a fluoronitrile, and mixtures and/or decomposition products thereof. In particular, the insulation gas may comprise as a hydrocarbon at least $CH_4$, a perfluorinated and/or partially hydrogenated organofluorine compound, and mixtures thereof. The organofluorine compound is preferably selected from the group consisting of: a fluorocarbon, a fluoroether, a fluoroamine, a fluoronitrile, and a fluoroketone; and preferably is a fluoroketone and/or a fluoroether, more preferably a perfluoroketone and/or a hydrofluoroether, more preferably a perfluoroketone having from 4 to 12 carbon atoms and even more preferably a perfluoroketone having 4, 5 or 6 carbon atoms. The insulation gas preferably comprises the fluoroketone mixed with air or an air component such as $N_2$, $O_2$, and/or $CO_2$.

In specific cases, the fluoronitrile mentioned above is a perfluoronitrile, in particular a perfluoronitrile containing two carbon atoms, and/or three carbon atoms, and/or four carbon atoms. More particularly, the fluoronitrile can be a perfluoroalkylnitrile, specifically perfluoroacetonitrile, perfluoropropionitrile ($C_2F_5CN$) and/or perfluorobutyronitrile ($C_3F_7CN$). Most particularly, the fluoronitrile can be perfluoroisobutyronitrile (according to formula $(CF_3)_2CFCN$) and/or perfluoro-2-methoxypropanenitrile (according to formula $CF_3CF(OCF_3)CN$). Of these, perfluoroisobutyronitrile is particularly preferred due to its low toxicity.

The switch comprises also other parts such as nominal contacts, a drive, a controller, and the like, which have been omitted in the Figures and are not described herein. These parts are provided in analogy to a conventional Low- or Medium-Voltage load break switch.

The load break switch may be used as a low- or medium voltage load break switch. This includes the use as a disconnector in a setting in which an arc cannot be excluded, and/or as a switch-fuse combination switch.

The load break switch may be provided as a part of a gas insulated ring main unit. Thus, according to a further aspect of the invention, a distribution network, Ring Main Unit, or secondary distribution gas-insulated switchgear is provided, having a load break switch as described herein.

The invention claimed is:

1. A gas-insulated low- or medium-voltage switch for system voltages within 1 to 52 kV and for up to 2000 A rated current, the switch comprising:

first and second contacts being movable in relation to each other along an axis of the switch and defining a quenching region in which an arc is formed during a current breaking operation; and an arc-extinguishing system for extinguishing the arc during the current breaking operation, including:

a pressurization system having a pressurizing chamber for pressurizing a quenching gas during the current breaking operation, wherein the pressurizing chamber is a puffer chamber with a piston arranged for compressing the quenching gas within the puffer chamber during the current breaking operation, and one of the piston and a remaining portion of the puffer chamber is movable together with the first or second contact;

a nozzle system connecting the pressurization system with the quenching region, the nozzle system having a nozzle at an outlet of the nozzle system for blowing the pressurized quenching gas onto the arc formed in the quenching region during the current breaking operation; and a swirling device configured for generating a subsonic swirl flow of the quenching gas onto the quenching region during the current breaking operation, wherein the swirling device is arranged at an entrance of the nozzle system.

2. The gas-insulated low- or medium-voltage switch according to claim 1, wherein the swirling device is arranged within the nozzle system or directly upstream of the nozzle system.

3. The gas-insulated low- or medium-voltage switch according to claim 2, wherein the entrance of the nozzle system is a pressurization-system side entrance of the nozzle system.

4. The gas-insulated low- or medium-voltage switch according to claim 3, wherein at least one of the swirling device and at least a portion of the nozzle system, such as the nozzle at the outlet of the nozzle system, extends along a center axis of the switch.

5. The gas-insulated low- or medium-voltage switch according to claim 3, wherein the nozzle system extends axially through the first contact, and the nozzle is formed in a tip section of the first contact.

6. The gas-insulated low- or medium-voltage switch according to claim 2, wherein at least one of the swirling device and at least a portion of the nozzle system, such as the nozzle at the outlet of the nozzle system, extends along a center axis of the switch.

7. The gas-insulated low- or medium-voltage switch according to claim 6, wherein the nozzle system extends axially through the first contact, and the nozzle is formed in a tip section of the first contact.

8. The gas-insulated low- or medium-voltage switch according to claim 2, wherein the nozzle system extends axially through the first contact, and the nozzle is formed in a tip section of the first contact.

9. The gas-insulated low- or medium-voltage switch according to claim 2, wherein the nozzle system has a first channel section of larger diameter and a second channel section of smaller diameter downstream of the first channel section.

10. The gas-insulated low- or medium-voltage switch according to claim 2, wherein the second channel section extends in the direction of the switch axis and has a substantially constant diameter over an axial length.

11. The gas-insulated low- or medium-voltage switch according to claim 2, wherein the first contact is a pipe-type contact, and the second contact is a pin-type contact.

12. The gas-insulated low- or medium-voltage switch according to claim 1, wherein the nozzle system has a first channel section of larger diameter and a second channel section of smaller diameter downstream of the first channel section.

13. The gas-insulated low- or medium-voltage switch according to claim 12, wherein a diameter of the nozzle system is continuously reduced from the first channel section to the second channel section.

14. The gas-insulated low- or medium-voltage switch according to claim 1, wherein the second channel section extends in a direction of the switch axis and has a substantially constant diameter over an axial length.

15. The gas-insulated low- or medium-voltage switch according to claim 1, wherein the first contact is a pipe-type contact, and the second contact is a pin-type contact.

16. The gas-insulated low- or medium-voltage switch according to claim 1, wherein said switch is a load break switch.

17. A method of performing the current breaking operation by the gas-insulated low- or medium-voltage switch according to claim 16, wherein the current is the rated current within the range of up to 2000 A through said switch, and wherein the system voltage is at most 52 kV, the method including:

separating the first and second contacts from each other by relative movement away from each other along the axis of the switch, so that the arc is formed in the quenching region between the first and second contacts; and blowing, by the arc-extinguishing system, the subsonic swirl flow of the quenching gas onto the quenching region.

18. A method of performing the current breaking operation by the gas-insulated low- or medium-voltage switch according to claim 1, wherein the current is the rated current within the range of up to 2000 A through said switch, and wherein the system voltage is at most 52 kV, the method including:

separating the first and second contacts from each other by relative movement away from each other along the axis of the switch, so that the arc is formed in the quenching region between the first and second contacts; and blowing, by the arc-extinguishing system, the subsonic swirl flow of the quenching gas onto the quenching region.

19. A distribution network, Ring Main Unit, or secondary distribution gas-insulated switchgear having a load break switch comprising:

first and second contacts being movable in relation to each other along an axis of the switch and defining a quenching region in which an arc is formed during a current breaking operation; and an arc-extinguishing system for extinguishing the arc during the current breaking operation, including:

a pressurization system having a pressurizing chamber for pressurizing a quenching gas during the current breaking operation, wherein the pressurizing chamber is a puffer chamber with a piston arranged for compressing the quenching gas within the puffer chamber during the current breaking operation, and one of the piston and a remaining portion of the puffer chamber is movable together with the first or second contact;

a nozzle system connecting the pressurization system with the quenching region, the nozzle system having a nozzle at an outlet of the nozzle system for blowing the pressurized quenching gas onto the arc formed in the quenching region during the current breaking operation; and a swirling device configured for generating a subsonic swirl flow of the quenching gas onto the quenching region during the current breaking operation, wherein the swirling device is arranged at an entrance of the nozzle system.

* * * * *